US005410217A

United States Patent [19]

LaPointe

[11] Patent Number: 5,410,217

[45] Date of Patent: Apr. 25, 1995

[54] ELECTROLUMINESCENT LAMPS AND DISPLAYS HAVING THICK FILM AND MEANS FOR ELECTRICAL CONTACTS

[75] Inventor: Bradley J. LaPointe, Shorewood, Minn.

[73] Assignee: Leading Edge Industries, Inc., Minnetonka, Minn.

[21] Appl. No.: 189,989

[22] Filed: Jan. 31, 1994

[51] Int. Cl.[6] ..... H01J 1/62

[52] U.S. Cl. ..... 313/509; 313/506; 313/498; 313/50; 313/511; 313/502; 313/505; 313/493; 315/169.4; 359/88; 445/24; 445/50

[58] Field of Search ..... 313/509, 506, 498, 50, 313/502, 505, 493; 315/169.3, 169.4; 359/50, 88; 445/24, 50

[56] References Cited

U.S. PATENT DOCUMENTS

| | | | |
|---|---|---|---|
| 3,153,167 | 10/1964 | Renton et al. | 313/108 |
| 3,254,254 | 5/1966 | Buck | 313/108 |
| 3,281,619 | 10/1966 | Greene | 313/108 |
| 3,330,982 | 7/1967 | Dickson, Jr. | 313/108 |
| 4,482,580 | 11/1984 | Emmett et al. | 313/502 |
| 4,743,801 | 5/1988 | Yokoyama et al. | 313/512 |
| 4,775,964 | 10/1988 | Alessio et al. | 368/67 |
| 5,045,755 | 9/1991 | Appelberg | 313/498 |
| 5,120,618 | 6/1992 | Mori et al. | 428/690 |
| 5,184,969 | 2/1993 | Sharpless et al. | 313/505 |

*Primary Examiner*—Donald J. Yusko
*Assistant Examiner*—Ali Horri
*Attorney, Agent, or Firm*—Michael J. Weins

[57] ABSTRACT

Improved thick film electroluminescent lamps and displays which provide a moisture barrier for the phosphor layer of an electroluminescent lamp and allows all of the contacts for the lamp or the display to reside within the footprint of the lamp. The moisture barrier is provided without employing a pair of encapsulating polymer sheets. The resulting lamps and displays are provided with vias which allow leads to be attached to a front electrode and one or more back electrodes employed to provide a potential across a phosphor layer therebetween causing the phosphor to emit light. A second dielectric layer is deposited over the underlying architecture of the lamp or display and forms a seal with an exposed continuous band of a phosphor free front electrode which surrounds the perimeter of the lamp and also seals with a phosphor free region at the bottom of the vias which it passes down. The dielectric layer also seals any passages provided which traverse the lamp or display.

14 Claims, 5 Drawing Sheets

ELECTROLUMINESCENT LAMPS AND DISPLAYS HAVING THICK FILM AND MEANS FOR ELECTRICAL CONTACTS

FIELD OF THE INVENTION

The present invention relates to encapsulated screen printable lamps and displays having contacts which lie within the footprint of the lamp.

BACKGROUND OF THE INVENTION

Electroluminescent lamps have a phosphor-bearing dielectric layer between two electrodes. A front electrode is provided which is a transparent conductor such as indium tin oxide while a back electrode is provided which can be a non-transparent conductor. When the two electrodes are maintained at different potentials, a phosphor-bearing dielectric layer emits light which radiates through the transparent electrode and provides a light source for the lamp. Electroluminescent displays are similar to lamps with the exception that multiple pairs of electrodes are used so that selected regions of the displays can be lighted.

There are two types of electroluminescent lamps, thin film and thick film lamps. Thin film lamps are usually formed by deposition of the electrodes and the circuit architecture onto a glass substrate. U.S. Pat. Nos. 3,153,167 and 3,254,254 teach two such lamps. To extend the life of the resulting lamp, the lamp is encapsulated in glass to preserve the integrity of the phosphor layer. The encapsulation protects the phosphor layer from the deleterious effects of moisture. Metal contacts and leads are employed to connect voltage sources to the electrodes and these contacts and leads can be sealed into the encapsulating glass by packing the electrode with glass beads and sintering the beads to form a seal between the contacts and leads and the encapsulating glass. Since the contacts and leads can be fused into the encapsulating glass, they can be arranged at will and thus, a lamp having all contacts within the footprint of the lamp can be readily attained. While thin film lamps have many advantages, they are difficult to manufacture, will frequently fail if bent, and are relatively heavy. Some of these problems associated with thin film lamps have been cured by thick film lamps.

Thick film lamps usually employ a polymer film such as a MYLAR® film as a substrate rather than a glass plate. The architecture for the lamp is either applied by printing onto the base film, or by rolling the additional layers forming the architecture onto the base film. U.S. Pat. Nos. 5,045,755 and 5,120,618 are examples of typical thick film lamps. Thick film lamps are encapsuled by being sandwiched between plastic sheets which are sealed around the periphery of the lamp to avoid the deleterious effects of moisture on the phosphor layer. While thick film lamps have overcome many of the problems associated with thin film lamps such as weight and their fragile nature, the encapsulation in envelopes formed from lamination sheets necessitates the use of side electrical connectors that must be sandwiched between the sheets and substantially limits where connections can be made.

A partial solution to the problem of moisture without encapsulation is offered by U.S. Pat. No. 4,775,964 which provides limited protection for phosphor layers of an electroluminescent lamp for a watch face. The '964 patent employs a layer of barium titanate over architecture to resist moisture. While the barium titanate reduces the exposed area of the phosphor layer which is subject to moisture, the phosphor will still be subject to the effects of moisture at the edges of the watch face, around the contact of the lamp, and in the vicinity of a hole which is punched through the watch face to accommodate a shaft on which the watch hands rotate. Thus, to avoid these problems, it would be necessary to have a sealed watch housing or to employ an envelope such as taught in U.S. Pat. No. 4,743,801, the latter not being practical since not only do the contacts lie outside the footprint of the lamp but also the lamps must be pierced to allow a shaft to pass therethrough.

Thus, there is a need for a thick film lamp and display where there is freedom in the placement of contacts for the lamp or display within the footprint of the lamp or display while maintaining the integrity of the seal protecting the phosphor layer.

OBJECTS OF THE INVENTION

It is an object of the invention to provide printed electroluminescent lamps and displays which have contacts within the footprint of the resulting lamp or display.

It is another object of the invention to provide electroluminescent lamps and displays with extended lives.

It is still another object of the invention to provide lamps and displays where a large fraction of the surface of the resulting lamp or display is an active light emitting surface.

It is another object of the invention to provide a printed lamps and displays which are stackable on circuity used for their control.

It is still another object of the invention to provide a moisture barrier for electroluminescent lamps and displays without requiring the lamination of the resulting lamp or display between polymer sheets.

It is still another object of the invention to provide lamps and displays where the peripheral edge of the resulting lamp or display is not traversed by conductors.

It is yet a further object of the invention to provide lamps and displays wherein the footprint of the conductive pads for the transparent conductor will be small, allowing greater freedom in the lighting design.

These and other objects of the invention will become apparent from the following description, drawings, and claims.

SUMMARY OF THE INVENTION

The present invention provides an improved electroluminescent lamp or display which is suitable for screen printing and a method for printing the same. While the invention will be primarily discussed in terms of electroluminescent lamps, one should appreciate the improvement of the present invention provides the same benefit to electroluminescent displays. The lamp has electrodes as well as multiple layers of architecture which are deposited onto a polymer film. The polymer film is bounded by a peripheral edge and the architecture, including the contacts therefore, is arranged on the polymer film within the confines of its peripheral edge. A transparent conductor is deposited onto the polymer film providing a front electrode. The method for fabricating the devices of the present invention will be generally discussed in terms of a two step process for fabrication of a polymer film with a transparent conductor film affixed thereto; however, composite films are commercially available to eliminate the necessity of the second step. One source for these composite films is Courtalds.

The front electrode has a contact region and a display region. The contact region and the display region are electrically connected, meeting at a contact/display interface.

A phosphor layer is deposited onto the display region of the front electrode terminating at the contact/display interface thereby retaining a phosphor free front electrode contact region. Similarly, the phosphor layer does not extend to the peripheral edge of the polymer film but terminates before the peripheral edge leaving a continuous phosphor free peripheral band of the front electrode.

A first dielectric layer such as barium titanate is deposited on the phosphor layer. The dielectric layer has a high dielectric constant, K and thus, provides the appropriate AC field for excitation of the phosphor layer.

A second conductive layer is deposited on the first dielectric layer forming a back electrode. A second dielectric layer is deposited over the back electrode and extends therebeyond. The second dielectric layer unlike the first dielectric layer, does not terminate at the edge of the layer of which it is deposited but rather extends onto the continuous phosphor free peripheral band of the front electrode and is bonded thereto. The second dielectric layer also extends radially onto the phosphor free front electrode contact region for a limited distance and bonds thereto, sealing the contact/display interface. The limitation of the extension of the second dielectric layer into the phosphor free front electrode contact region leaves an exposed contact region of the front electrode for connection to a front electrode lead.

It is preferred that a contact pad be provided and form the phosphor free front electrode contact region. The contact pad provides a low resistance path between the front electrode lead and the front electrode. The contact pad will reduce the current density and also provide additional material to maintain the integrity of the contact when subjected to the forces associated with the connection of the front electrode lead for energizing the front electrode. When the lamp is fabricated by printing, the contact pad can be co-printed with the back electrode.

It is further preferred that the second dielectric layer extend onto the continuous phosphor free band to generate a band of overlap by a distance D which is at least 0.01 inches to assure moisture resistance of the seal for the phosphor in the vicinity of the peripheral edge of the polymer film. This width is sufficient to assure sealing between the polymer component of the front electrode and the polymer component of the second dielectric layer. Similarly, it is preferred that the second dielectric layer extend onto the contact region a distance d which is at least 0.01 inches. It is further preferred that the thickness t of the second dielectric layer be at least 0,001 inches.

Since the contact for the front electrode lead to the front electrode is internal, an opening is provided which passes through the second dielectric layer, the back electrode, the first dielectric layer, and the phosphor layer creating a front electrode via through which the front electrode lead can pass. It is necessary that the opening in the back electrode be larger than the opening in the first dielectric layer and the phosphor layer when the back electrode is co-printed with the contact pad to assure isolation of the back electrode from the contact pad. Having the opening in the back electrode larger than the opening in the first dielectric layer and the phosphor layer will also assure isolation of the back electrode from the front electrode lead passed therethrough.

When the second dielectric layer is deposited onto the back electrode by silk screening, the excluded area of printing can be adjusted such that the second dielectric layer passes down and deposits on the wall of the front electrode via and attaches to the front contact region. This dielectric layer provides a seal of the passage surface and further isolates the structure from the front electrode lead.

Again, since a back electrode lead will contact the back electrode within the footprint of the lamp, a back electrode opening is provided in the second dielectric layer which serves as a back electrode via providing access to the back electrode.

When a display is desired where selected areas of the phosphor layer are illuminated, selective illumination can be obtained by replacing the back electrode with multiple shaped electrodes which are spaced apart from the front electrode and have the phosphor layer and the first dielectric layer therebetween.

BEST MODE OF CARRYING THE INVENTION INTO PRACTICE

Figure 1:
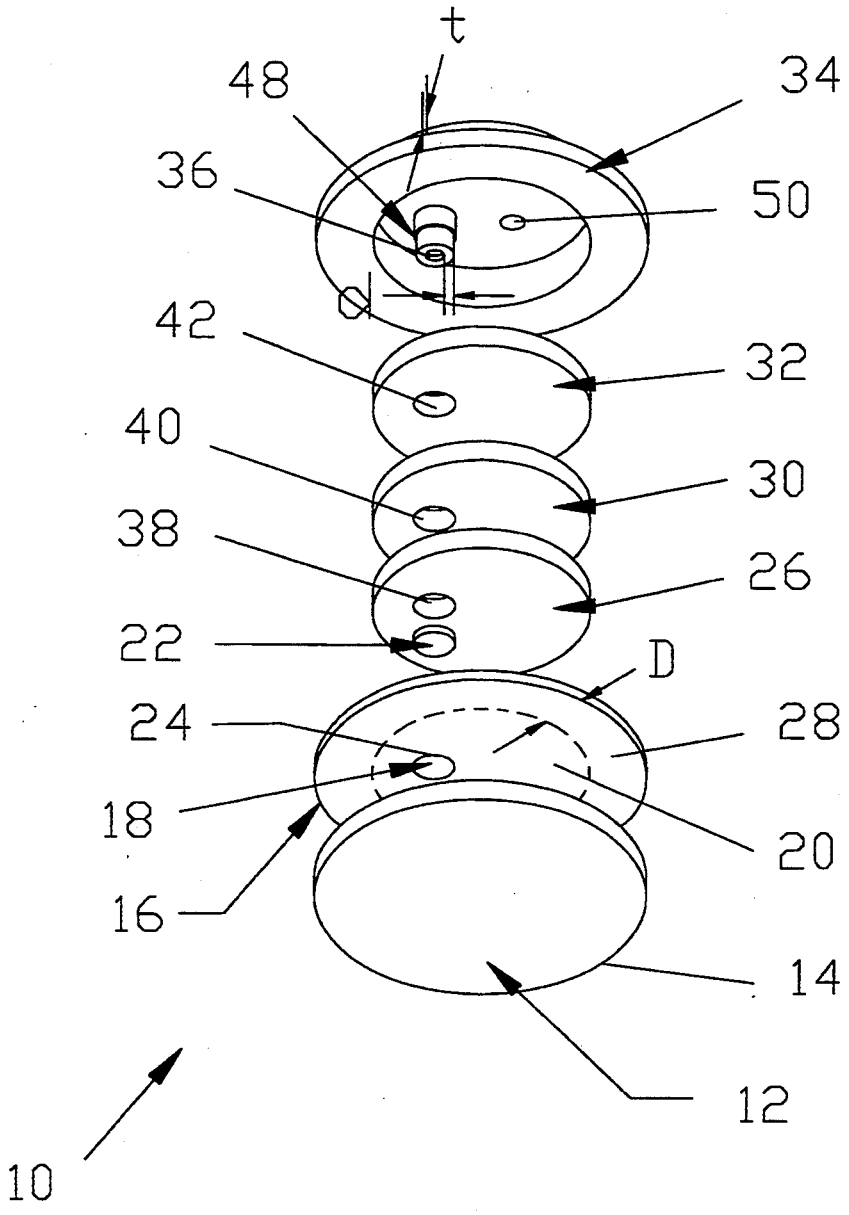
FIG. 1 is an exploded isometric drawing of one embodiment of the lamp of the present invention.

FIG. 1 illustrates one embodiment of a lamp of the present invention. An electroluminescent lamp 10 is shown in an exploded isometric view. The lamp 10 of this embodiment is fabricated by screen printing electrodes as well as multiple layers of architecture onto a polymer film 12 such as a MYLAR ® film. The polymer film 12 is bounded by a peripheral edge 14. A transparent conductor is deposited providing a front electrode 16. Polymer films with transparent conductors affixed thereto are commercially available by suppliers such as Courtaids and using such polymer film with a transparent conductor affixed thereto simplifies the fabrication of the lamp 10 by reducing the number of steps required to fabricate a lamp. The front electrode 16 has a front electrode contact region 18 which is employed for connecting to a front electrode lead (not shown) for maintaining the front electrode 16 at a prescribed potential. The front electrode 16 also has a display region 20. The architecture of all layers deposited onto the front electrode 16 is adjusted to fit within the boundary of the peripheral edge 14 of the polymer film 12. A contact pad 22 is provided and forms the front electrode contact region 18 the extremities of which define a contact/display interface 24 between the front electrode contact region 18 and the display region 20.

A phosphor layer 26 is deposited onto the display region 20 of the front electrode 16 terminating at the contact/display interface 24, maintaining the front electrode contact region 18 phosphor free.

The phosphor layer 26, while being deposited over a substantial portion of the front electrode 16 terminates inside of the peripheral edge 14 of the polymer film 12 and the overlaid front electrode 16 provides a continuous phosphor free peripheral band 28 of the front electrode 16.

A first dielectric layer 30 with a high dielectric constant K such as barium titanate is deposited on the phosphor layer 26 to provide an insulating layer enabling higher potential to be maintained across the phosphor layer 26 to intensify its illumination. The first dielectric layer 30 is co-extensive with the phosphor layer 26.

A second conductive layer is deposited on the first dielectric layer 30 forming a back electrode 32 which is co-extensive with the first dielectric layer 30. A second dielectric layer 34 is deposited over the back electrode 32. However, the second dielectric layer 34, rather than being co-extensive with the back electrode 32, the first dielectric layer 30 and the phosphor layer 26, extends beyond these layers to the front electrode 16 and the contact pad 22 which lie therebelow. The second dielectric layer 34 extends onto the continuous phosphor free peripheral band 28 of the front electrode 16 and is bonded thereto. The second dielectric layer 34 also extends onto a portion of the contact pad 22, and is bonded thereto. The second dielectric layer 34, by extending over a portion of the contact pad 22 provides a seal for the contact/display interface 24 and yet leaves an exposed contact region 36.

It is further preferred that the second dielectric layer 34 extend beyond the phosphor layer 26 onto the continuous phosphor free peripheral band 28 a distance D which is at least 0.01 inches to assure a moisture resistant seal of the phosphor layer 26 in the vicinity of the continuous phosphor free peripheral band 28. This distance is sufficient to assure bonding between the polymer in the front electrode 16 and the polymer of the second dielectric layer 34. It is still further preferred that this overlap be increased to about at least 0.025 inches to allow for irregularities in the printing or contamination by dust or other foreign materials of the structure onto which the materials are being deposited. Similarly, it is preferred that the second dielectric layer 34 extend onto the contact pad 22 a distance d which is at least 0.01 inches and more preferably 0.025 inches. It is further preferred that the thickness t of the second dielectric layer 34 be at least 0.001 inches.

Since the lamp 10 has its peripheral edge 14 sealed and free from interruption by conductor leads, the contact pad 22 will be internal to the display region 20 of the front electrode 16. To provide access to the front electrode 16 by the front electrode lead (not shown), a front electrode lead phosphor layer opening 38 is provided in the phosphor layer 26 and a front electrode lead first dielectric opening 40 which is aligned with the front electrode lead phosphor layer opening 38 is provided in the first dielectric layer 30. The back electrode 32 is provided with a front electrode lead back electrode opening 42 which is aligned with and larger than the front electrode lead phosphor layer opening 38 and the front electrode lead first dielectric opening 40.

The front electrode lead back electrode opening 42 is larger than the front electrode lead first dielectric opening 40 providing an opening larger than the front electrode contact region 18 so that when the contact pad 22 is simultaneously printed with the back electrode 32 from a common screen, the areas will remain electrically isolated. A front electrode lead second dielectric opening 44 (shown in FIG. 2) is provided which is aligned with the front electrode lead phosphor layer opening 38. The front electrode lead first dielectric opening 40, the front electrode lead back electrode opening 42 and the front electrode lead second dielectric opening 44, in combination, provide a front electrode via 46 (shown in Figure 2). The front electrode via 46 is lined with dielectric material providing a front electrode via sleeve 48 which seals to the contact pad 22.

Again since the contact for the back electrode 32 is internal to the peripheral edge 14 of the lamp 10, a back electrode opening 50 is provided which passes through the second dielectric layer 34 and provides a back electrode via 52 (shown in FIG. 2) providing an electrical contact to the back electrode 32.

Figure 2:
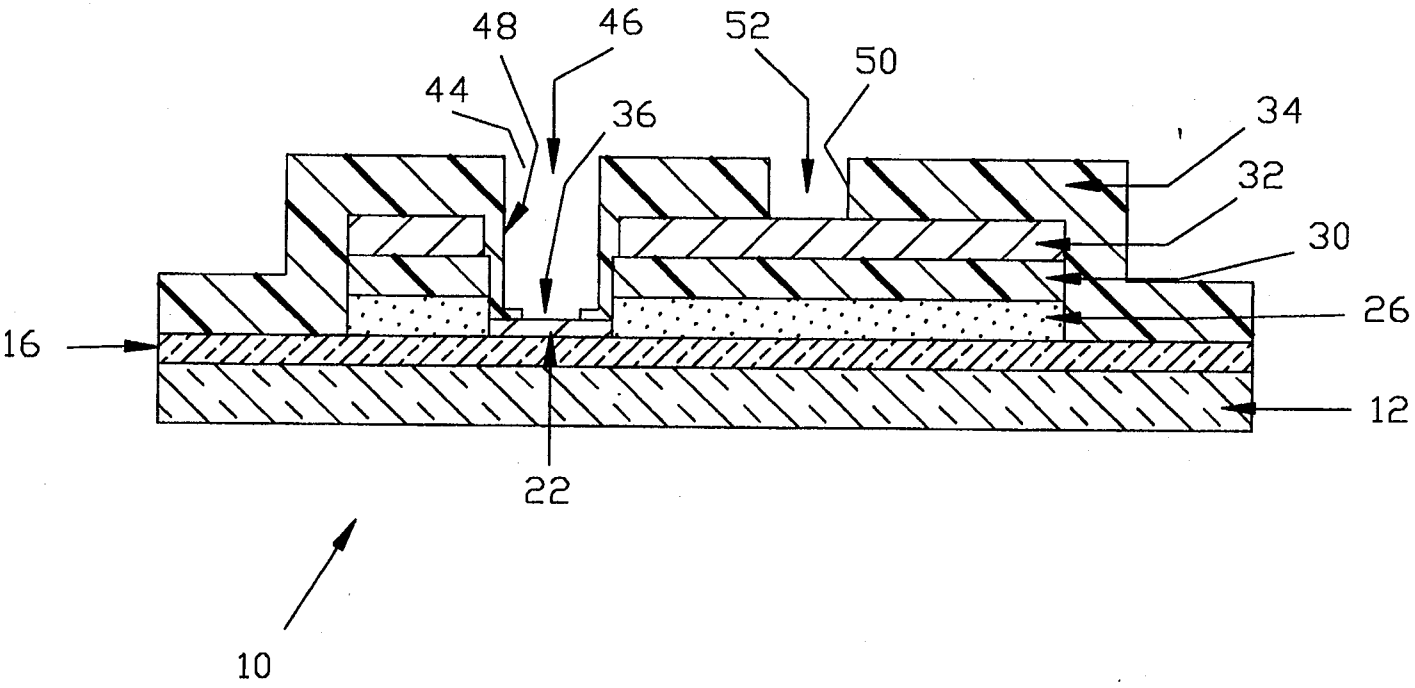
FIG. 2 is a cross section of the assembled lamp of FIG. 1.

FIG. 2 is a cross section of the lamp 10 of FIG. 1 which better illustrates the connectivity of the various layers. The lamp 10 of FIG. 1 can be fabricated solely by screen printing. The print sequence for fabrication of the lamp 10 can be summarized as follows.

The polymer film 12 is employed which forms the substrate for the resulting lamp 10. A transparent conductor ink such as Acheson #SS24823 is screen printed onto the polymer film 12 forming the front electrode 16. As discussed earlier, polymer films with the attached transparent conductors are commercially available allowing one to purchase as starting stock a material that will eliminate the first step of the fabrication process.

A phosphor ink made from phosphor powder (such as supplied by Sylvania Corporation) is blended with a polymeric binder (such as cyanoethylated polymers which are available from Biddle Sawyer Corporation) and is screen printed to form the display region 20 on the front electrode 16 (see FIG. 1). The screen used is patterned to leave the front electrode contact region 18 phosphor free and the continuous phosphor free peripheral band 28 free of phosphor as shown in FIG. 1.

The first dielectric layer 30 is screen printed onto the phosphor layer 26 with an ink such as a barium titanate powder blended with a polymeric binder. The back electrode 32 is printed onto the first dielectric layer 30 with a conductive ink. The conductive ink typically is made with a conductive powder such as silver (available from Acme Chemicals and Insulator Company) which is blended with a polymeric binder as discussed above. As shown in FIG. 1, the front electrode lead back electrode opening 42 in the back electrode 32 is larger than the front electrode lead first dielectric opening 40 in the first dielectric layer 30 and the front electrode lead phosphor layer opening 38 in the phosphor layer 26. The same screen can be used to simultaneously print the contact pad 22 when the openings are patterned as discussed above.

The art work for printing the second dielectric layer 34 provides a dielectric layer with the front electrode via 46 providing access to the front electrode contact pad 22. The art work is so configured such that the ink for the second dielectric layer 34 will deposit on the exposed surfaces of the openings in the layers forming the front electrode via 46.

Similarly, the art work for the screen for providing the back electrode via 52 is maintained in the screen for the second dielectric layer 34.

Figure 3:
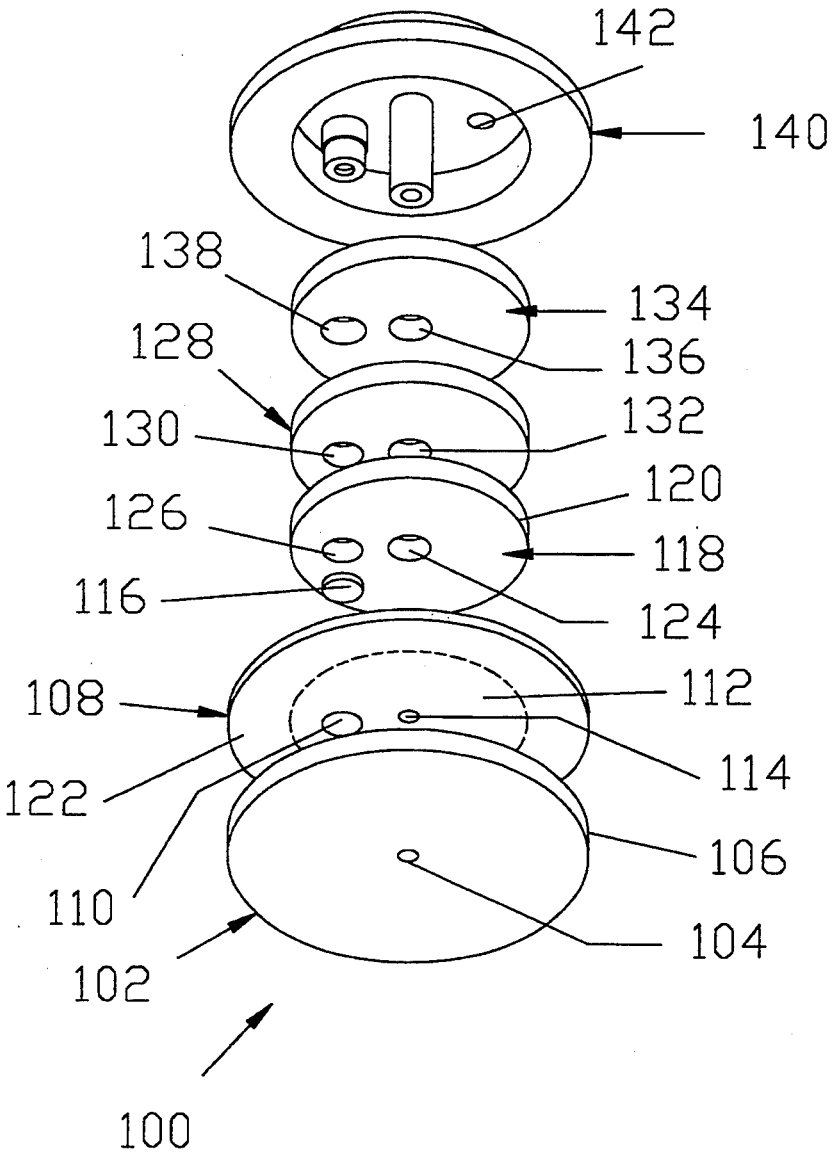
FIG. 3 is an exploded embodiment of the present invention where the lamp has a central passage therethrough making it suitable for use as a back lit face for a watch or dial needing a passage therethrough for passage of a stem on which watch hands or a needle can be mounted.

FIG. 3 is an exploded isometric view of another embodiment of a lamp of the present invention. This lamp 100 is designed to provide back lighting for a dial of a watch or a gage. The lamp 100 has a polymer film 102 which serves as the substrate of the lamp 100. The polymer film 102 has a substrate shaft passage 104 therethrough. The polymer film 102 is bounded by a peripheral edge 106. The polymer film 102 has affixed thereto a transparent conductor providing a front electrode 108. The front electrode 108 has a front electrode contact region 110 and a front electrode display region 112. The front electrode 108 has a front electrode shaft passage 114 therethrough. Again, architecture of all subsequent layers is maintained within the confines of the polymer film 102.

A contact pad 116 is provided for the front electrode contact region 110. A phosphor layer 118 is deposited onto the front electrode 108. The phosphor layer 118 is bounded by a phosphor peripheral edge 120 which limits the phosphor layer 118 such that a continuous phosphor free peripheral band 122 results. The phosphor layer 118 has a phosphor layer shaft passage 124 which has a larger cross section than the cross section of the substrate shaft passage 104. The phosphor layer 118 also has a front electrode lead phosphor opening 126 through which a first conductive lead (not shown) can be passed for establishing electrical contact with the contact pad 116. A first dielectric layer 128 is provided which is coextensive with the phosphor layer 118 and provides a front electrode lead first dielectric opening 130 and a first dielectric shaft passage 132.

A back electrode 134 is deposited onto the first dielectric layer 128 leaving a back electrode shaft passage 136 and a first conductor lead back electrode opening 138. When the back electrode 134 is co-deposited with the contact pad 116, the first conductor lead back electrode opening 138 should be larger than the front electrode lead first dielectric opening 130. The phosphor layer shaft passage 124, the first dielectric shaft passage 132 and the back electrode shaft passage 136 are aligned to form a phosphor/first dielectric/second electrode composite shaft passage which is aligned with the substrate shaft passage 104.

A second dielectric layer 140 is deposited over the back electrode 134 but extends beyond and into the contact pad 116 sealing thereto. Similarly, the second dielectric layer 140 passes down the phosphor/first dielectric/second electrode composite shaft passage and adheres to the front electrode 108 sealing the passage and sealing the phosphor layer 118 from moisture. Again, the overlap of the second dielectric layer 140 with the front electrode 108 should be at least 0.01 inches.

The second dielectric layer 140 also extends onto the continuous phosphor free peripheral band 122 of the front electrode 108 completing the seal for the phosphor layer 118. A back electrode opening 142 is provided in the second dielectric layer 140 for a back electrode lead.

Figure 4:
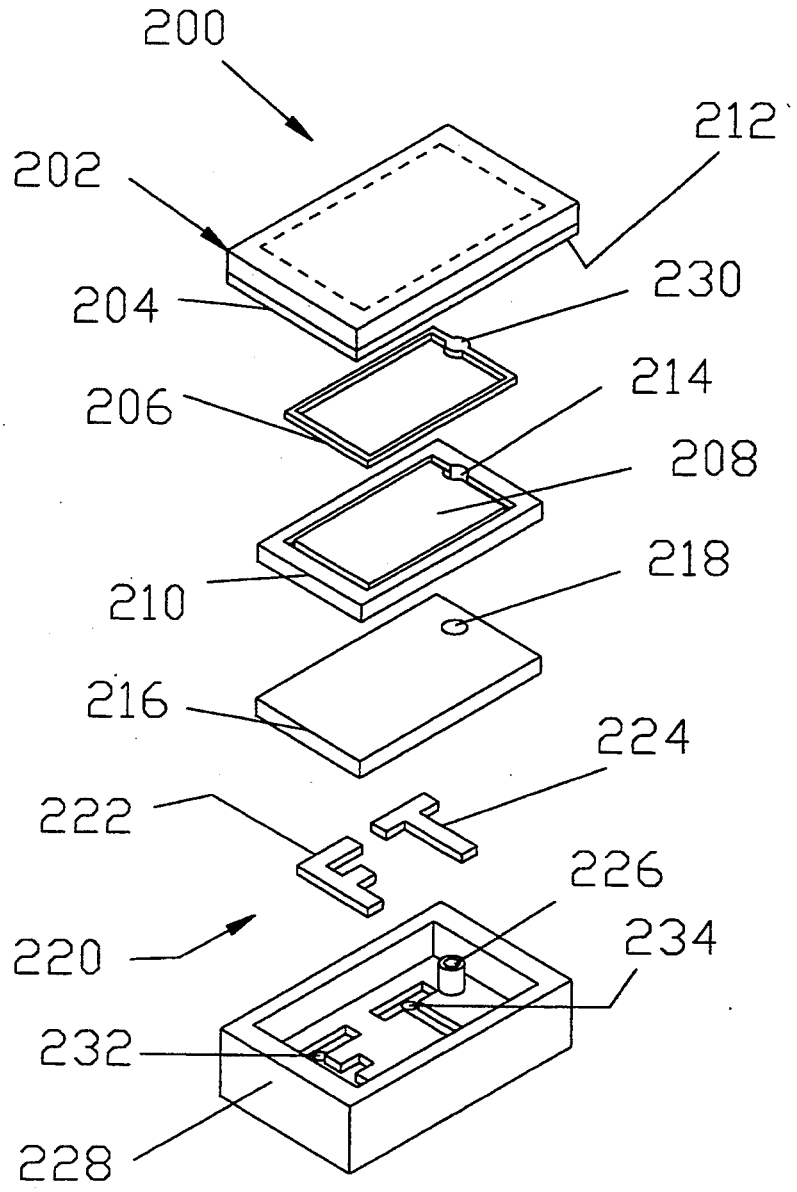
FIG. 4 is an exploded view of a display employing the improvement of the present invention. This display allows selective areas to be illuminated. The display eliminates the need for central pads on the front electrode, thereby increasing the effective lighting region. The selective lighting is accomplished by providing multiple electrodes which are spaced apart from the front electrode and are electrically isolated. The display illustrated has two electrodes which are spaced apart. These electrode sections have separate contacts. As illustrated, all contacts reside near the peripheral edge of the display region of the lamp.

FIG. 4 is an exploded isometric view of an embodiment of the present invention for a display employing multiple back electrodes. In this embodiment, a display 200 is provided which can have selected regions lit. In this embodiment, a polymer film 202 is employed which has as an integral part thereof, a front electrode 204 which is transparent. A contact pad 206 is provided which encloses a display region 208 of the display 200. A phosphor layer 210 is deposited onto the front electrode 204 and the contact pad 206 leaving a continuous phosphor free band 212 around the perimeter of the front electrode 204. A front electrode lead phosphor opening 214 is provided in the phosphor layer 210 to allow the lead (not shown) to be attached to the contact pad 206.

A first dielectric layer 216 is deposited onto the phosphor layer 210 and has a front electrode lead first dielectric opening 218. In this embodiment, a group of back electrodes 220 is employed. For this example, two group electrodes are employed. A first group electrode 222 and a second group electrode 224, which are spaced apart, are provided. The second group electrode 224 is configured such that a front electrode lead opening 226 passes outside the confines of the second group electrode 224 in which case the non-electrode region of the group of back electrodes 220 serves as a group electrode opening. Alternatively, the back group electrode opening could pass through one of the group electrodes.

A second dielectric layer 228 is deposited over the structure therebelow and bonds to a contact region 230 of the contact pad 206 and the continuous phosphor free band 212 sealing the phosphor layer 210.

The second dielectric layer 228 has a first group electrode lead opening 232 and a second group electrode lead opening 234. These openings allow a potential to be selectively applied to the first group electrode 222 and the second group electrode 224.

The leads can be connected to the front electrode 204 and to the group of back electrodes 220 by a variety of techniques known in the art. These include pressure fit and conductive adhesives.

While all the above embodiments employ phosphor layers where the front electrode lead phosphor layer opening falls within the phosphor layer, this opening can be contiguous to the continuous phosphor free peripheral band of the front electrode or may in the limit provide a pseudo opening which resides in the continuous phosphor free band.

Figure 5:
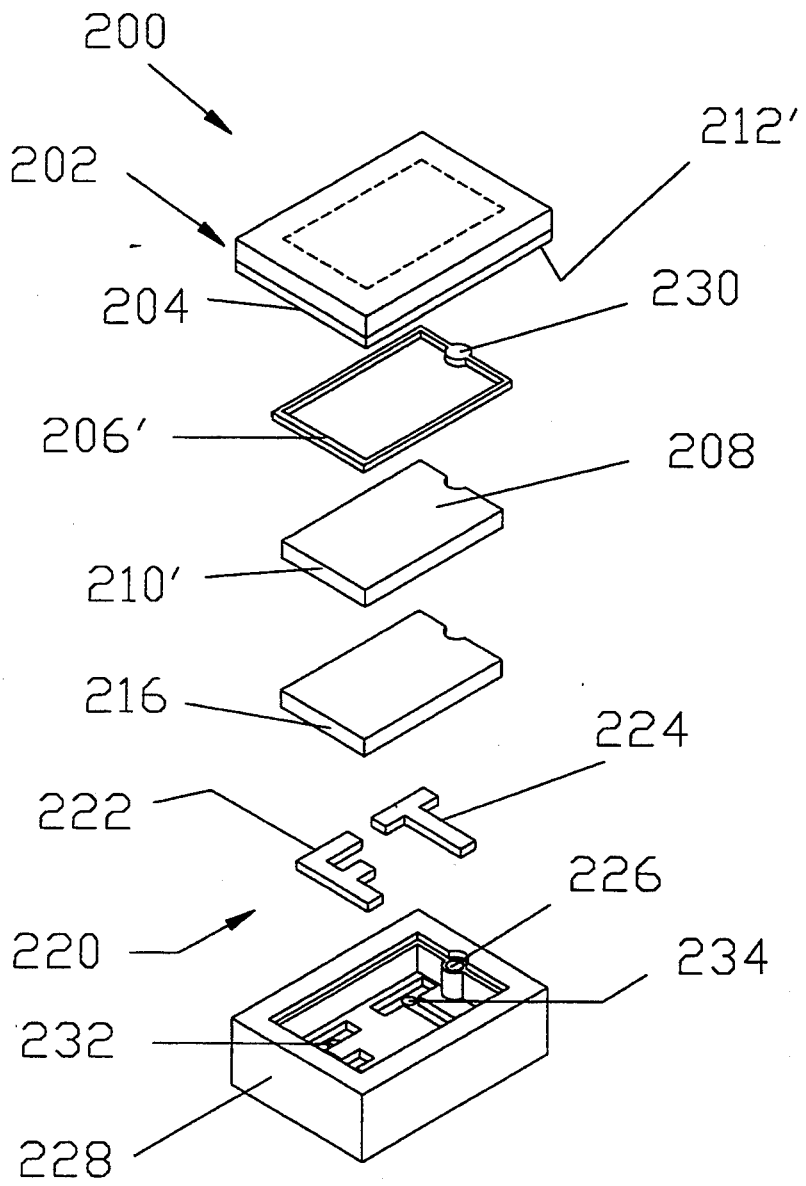
FIG. 5 is an exploded isometric view of the present invention which is similar to FIG. 4. In this embodiment, the contact pad is external to the phosphor layer.

FIG. 5 illustrates a display where a contact pad 206' lies outside the phosphor layer 210'. With this configuration, the continuous phosphor free band 212' of the front electrode 204 substitutes for the opening in the phosphor layer 210' serving as a pseudo opening in the phosphor layer and allows the full illumination of the phosphor layer 210'.

The leads to the electrodes can be secured to the contacts and electrodes by maintaining a pressure between the lamp and underlying printed circuit boards having leads. Pressure can be particularly effective when the contact on the lamp are near the perimeter of the lamp and the lamp is secured by clips which apply pressure to the perimeter of the lamp.

Alternatively, there are adhesives with non-isotropic electrical conductivity (so-called vertically or Z axis conductive adhesives such as those offered by 3M Adhesives). These adhesives, when used to attach the lamp, will assure a conductive path between the lead and the electrodes.

Lamps/displays such as described above can be fabricated by a variety of techniques employing multiple depositions of layers onto a polymer substrate. The substrate typically will be a polymer such as a Mylar® film. These films are commercially available with a transparent electrode affixed. Alternatively, a transparent electrode can be deposited either by vapor deposition or by screen printing a transparent electrode onto the film substrate forming a front electrode.

Once a substrate having a peripheral edge has been provided with a front electrode attached thereto, a phosphor layer is deposited thereon. The front electrode is masked such that the phosphor layer is selectively deposited thereon. The resulting phosphor layer so deposited defines a display region and leaves exposed a phosphor free contact region and a continuous phosphor free peripheral band of the front electrode. The phosphor free region and the continuous phosphor free region can be either spaced apart, contiguous, or superimposed. To simplify the fabrication the phosphor layer is preferably deposited by screen printing with a phosphor ink such as described above.

The substrate is masked such that a first dielectric layer is deposited onto the phosphor layer and is coextensive therewith thereby leaving exposed the phosphor free contact region and the continuous phosphor free peripheral band of the front electrode. Again, for simplicity, it is preferred that the deposition be by screening and that the layer be screen printed.

Again, the substrate is masked and a second conductive layer is deposited onto the first dielectric layer. This layer, when coextensive with the phosphor layer, will result in the total phosphor layer being illuminated when a potential is applied between the front electrode and the back electrode. Alternatively, when a patterned electrode is employed, the pattern will be displayed by the phosphor. The back electrode is patterned. Screen printing is preferred since it allows the back electrode to be printed while simultaneously printing a conductive pad onto the front electrode. The back electrode must be patterned so that the contact region of the front electrode remains exposed and electrically isolated from the back electrode. Similarly, the back electrode leaves exposed and electrically isolated the continuous phosphor free peripheral band of the front electrode.

A second dielectric layer is selectively deposited by masking the substrate and the structures deposited thereon. The second dielectric layer is deposited over and extends beyond the back electrode and is deposited onto the layers therebelow, forming a dielectric deposit on all exposed regions of the phosphor layer. The second dielectric layer bonds to a portion of the front electrode contact region sealing thereto while leaving a dielectric free segment of the contact region. The second dielectric layer also bonds to the continuous phosphor free band of the front electrode providing continuous sealing thereto. An opening in the dielectric deposit provides for a via through which a back electrode lead can be passed making contact with the back electrode.

In the case where the substrate has passages therethrough, there will be additional peripheral passage bands associated with the substrate passages which leave the exposed regions of the front electrode. Each of these passages has corresponding openings in the layers thereabove, such openings being larger than the diameter of a passage creating a passage via.

What I claim is:

1. An electroluminescent lamp comprising:

a polymer film having a peripheral edge;

a transparent conductor being deposited thereon providing a front electrode, said front electrode having a front electrode contact region and a display region defining a contact/display interface therebetween;

a phosphor layer being deposited onto said display region of said front electrode, said phosphor layer having a front electrode lead phosphor layer opening terminating at said contact/display interface providing a phosphor free contact region and said phosphor layer terminating before said peripheral edge of said polymer film providing a continuous phosphor free peripheral band of said front electrode;

a first dielectric layer being deposited onto said phosphor layer said first dielectric layer having a front electrode lead first dielectric layer opening aligned with said front electrode lead phosphor layer opening;

a second conductive layer being deposited on said first dielectric layer forming a back electrode leaving a front electrode lead back electrode opening which is aligned with said front electrode lead phosphor layer opening;

a second dielectric layer being deposited over said back electrode and extending therebeyond, said second dielectric layer providing coverage for exposed regions of said phosphor layer and said second dielectric layer bonding to said continuous phosphor free peripheral band of said front electrode and extending into a front electrode lead via formed by said front electrode lead phosphor layer opening, said front electrode lead first dielectric layer opening, said front electrode lead back electrode opening and said front electrode lead second dielectric opening, said second dielectric layer terminating at said front electrode contact region sealing the contact/display interface and leaving an exposed contact region for connection to a front electrode lead; and a back electrode lead second dielectric layer opening in said second dielectric layer forming a back electrode lead via.

2. The electroluminescent lamp of claim 1 wherein said front electrode contact region further comprises:

a contact pad extending said phosphor free contact region of said front electrode.

3. The electroluminescent lamp of claim 2 wherein said front electrode lead first dielectric opening is smaller than said front electrode lead back electrode opening.

4. The electroluminescent lamp of claim 3 wherein said second dielectric extends onto said phosphor free peripheral regions a distance D and onto said first contact d where:

$d > 0.01$ inches;

$D > 0.01$ inches; and further wherein said second dielectric layer has a thickness greater than 0.001 inches.

5. The electroluminescent lamp of claim 3 wherein said second dielectric extends onto said phosphor free peripheral regions a distance D and onto said first contact d where:

$d > 0.025$ inches;

$D > 0.025$ inches; and further wherein said second dielectric layer has a thickness t greater than 0.001 inches.

6. The electroluminescent lamp of claim 2 wherein said front electrode lead phosphor layer opening is contiguous with said continuous phosphor free peripheral band of said front electrode.

7. The electroluminescent lamp of claim 2 wherein said front electrode lead phosphor layer opening is superimposed on said continuous phosphor free peripheral band of said front electrode.

8. The electroluminescent lamp of claim 2 further comprising:

a substrate shaft passage through said polymer film & said transparent front electrode;

a phosphor layer shaft passage larger than said substrate shaft passage;

a first dielectric shaft passage larger than said substrate shaft passage;

a back electrode shaft passage larger than said substrate shaft passage, said phosphor layer shaft passage, said first dielectric shaft passage and said back electrode shaft passage forming a phosphor/first dielectric/-second electrode composite passage which is allied with said shaft passage; and further wherein said second dielectric layer passes down said dielectric/second electrode composite shaft passage and bonds with said polymer film.

9. An electroluminescent display comprising:

a polymer film having a peripheral edge;

a transparent conductor being deposited thereon providing a front electrode, said front electrode having a front electrode contact region and a display region defining a contact/display interface therebetween;

a phosphor layer being deposited onto said display region of said front electrode, said phosphor layer having a front electrode lead phosphor layer opening terminating at said contact/display interface providing a phosphor free contact region and said phosphor layer terminating before said peripheral edge of said polymer film providing a continuous phosphor free peripheral band of said front electrode;

a first dielectric layer being deposited onto said phosphor layer said first dielectric layer having a front electrode lead first dielectric layer opening aligned with said front electrode lead phosphor layer opening;

a second conductive layer being deposited on said first dielectric layer forming a back electrode group of electrically isolated back electrodes leaving a front electrode lead back electrode group opening which is aligned with said front electrode lead phosphor layer opening;

a second dielectric layer being deposited over said back electrode and extending therebeyond, said second dielectric layer providing coverage for exposed regions of said phosphor layer and said second dielectric layer bonding to said continuous phosphor free peripheral band of said front electrode and extending into a front electrode lead via formed by said front electrode lead phosphor layer opening, said front electrode lead first dielectric layer opening, and said front electrode lead second dielectric opening terminating at said front electrode contact region sealing the contact/display interface and leaving an exposed contact region for connection to a front electrode lead; and a back electrode lead second dielectric layer opening in said second dielectric layer forming a back electrode lead via.

10. The electroluminescent display of claim 9 further comprising:

a contact pad extending said phosphor free contact region of said front electrode.

11. The electroluminescent display of claim 10 wherein said group of back electrodes formed by said second conductive layer further comprises:

a first group electrode;

a second group electrode; and an electrode free region, said first group electrode and said second group electrode configured such that said front electrode lead back electrode group opening results from the electrode free region of the layer.

12. The electroluminescent display of claim 10 said group of back electrodes further formed by said second conductive layer comprising:

a first group electrode; and a second group electrode, said second group electrode having a second group electrode opening which provides said front electrode lead second group opening.

13. The electroluminescent display of claim 10 wherein a contact pad encloses the display region.

14. The electroluminescent display of claim 10 further comprising:

a substrate shaft passage through said polymer film & said transparent front electrode;

a phosphor layer shaft passage larger than said substrate shaft passage;

a first dielectric shaft passage larger than said substrate shaft passage;

a back electrode shaft passage larger than said substrate shaft passage, said phosphor layer shaft passage, said first dielectric shaft passage and said back electrode shaft passage forming a phosphor/first dielectric/-second electrode composite passage which is allied with said shaft passage; and further wherein said second dielectric layer passes down said dielectric/second electrode composite shaft passage and bonds with said polymer film.

* * * * *